US005791748A

United States Patent [19]

Marhefka

[11] Patent Number: 5,791,748

[45] Date of Patent: Aug. 11, 1998

[54] COMPACT DISC HOLDER

[75] Inventor: Matthew D. Marhefka, Richboro, Pa.

[73] Assignee: Computer Expressions Incorporated, Philadelphia, Pa.

[21] Appl. No.: 739,447

[22] Filed: Oct. 29, 1996

[51] Int. Cl.[6] ..... A47B 81/06

[52] U.S. Cl. ..... 312/9.48; 312/258; 312/350; 206/308.1; 211/40; D6/629

[58] Field of Search ..... 312/9.1, 9.48, 312/9.51, 9.64, 9.61, 9.59, 350, 301, 258, 259, 260, 261; D6/407, 629; 211/40, 41.1, 41.11, 41.12, 42; 206/307.1, 308.1, 308.2, 308.3, 309; 220/504, 529, 541, 550, 916

[56] References Cited

U.S. PATENT DOCUMENTS

| | | | |
|---|---|---|---|
| D. 307,977 | 5/1990 | Egly et al. . | |
| D. 308,599 | 6/1990 | Long et al. . | |
| D. 320,707 | 10/1991 | Garfinkle | D6/407 |
| D. 364,989 | 12/1995 | Lin | D6/629 |
| D. 365,243 | 12/1995 | Kwa | D6/629 |
| D. 374,582 | 10/1996 | Chu | D6/629 X |
| 2,256,995 | 9/1941 | Andres . | |
| 4,453,785 | 6/1984 | Smith . | |
| 4,678,245 | 7/1987 | Fouassier . | |
| 4,867,513 | 9/1989 | Choi | 312/258 |
| 4,884,512 | 12/1989 | Kelly et al. | 108/26 |
| 4,889,244 | 12/1989 | Hehn et al. . | |
| 5,097,946 | 3/1992 | Emrich . | |
| 5,226,704 | 7/1993 | Porter | 312/9.48 |
| 5,370,242 | 12/1994 | Huang | 211/40 |
| 5,385,398 | 1/1995 | Huys | 312/9.48 |
| 5,456,368 | 10/1995 | Zehnder | 211/40 |
| 5,458,238 | 10/1995 | Dominguez-Gutierrez | 206/308.3 X |
| 5,645,329 | 7/1997 | Madock | 206/308.1 X |

*Primary Examiner*—Peter M. Cuomo
*Assistant Examiner*—James O. Hansen
*Attorney, Agent, or Firm*—Norman E. Lehrer

[57] ABSTRACT

A collapsible compact disc holder comprises a housing with a lower wall, an upper wall, a pair of opposing side walls, and a pair of opposing open ends. Each of the upper and lower walls has a pair of opposing side edges. Each of the side edges of the upper wall is hingedly connected to a different one of the side walls and each of the side edges of the lower wall is hingedly connected to a different one of the side walls. The housing is adapted to be moved between an upright rectangular configuration, wherein each of the side walls of the housing extends perpendicularly from corresponding side edges of the upper and lower walls, to a collapsed configuration, wherein the upper wall extends from one of the side walls along the same plane and the lower wall extends from the other of the side walls along the same plane. First and second curved support members are provided. Each of the curved support members is insertable into one of the ends of the housing when the same is in the upright configuration. Each curved support member includes a column of vertically spaced apart slots for partially receiving a plurality of compact discs therein.

18 Claims, 3 Drawing Sheets

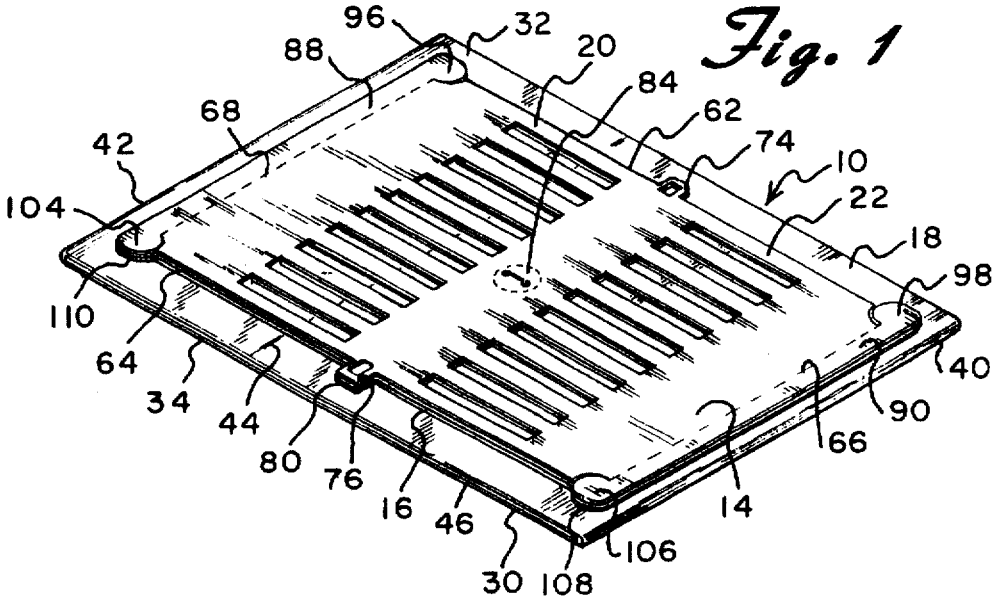
Fig. 1
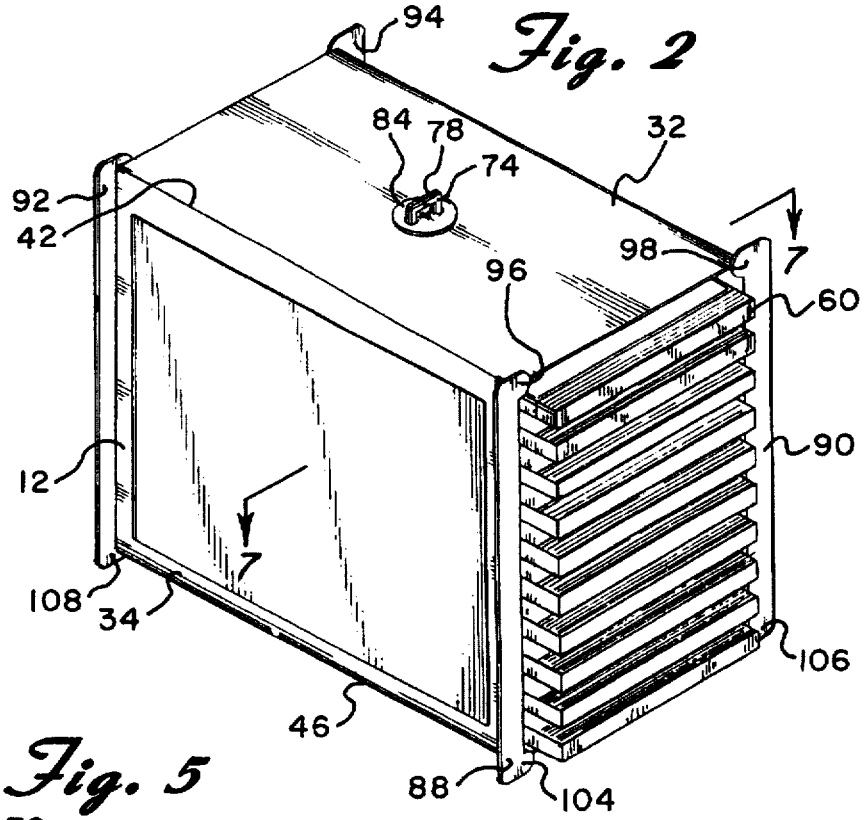
Fig. 2
Fig. 5
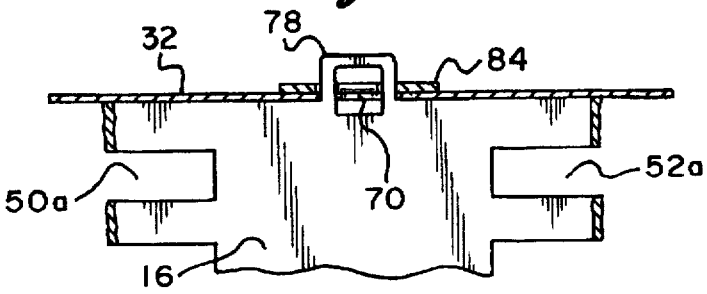

COMPACT DISC HOLDER

BACKGROUND OF THE INVENTION

The present invention is directed toward a collapsible compact disc (CD) holder and, more particularly, to such a holder which is adapted to store a plurality of compact discs in a space efficient manner while allowing each of the compact discs to be readily viewed.

Various devices have been developed which are adapted to store compact discs. These devices are typically characterized by their inability to allow compact discs stored within the holder to be readily viewed, their unattractive appearance, their relatively high cost, and their inefficient use of space. Furthermore, existing compact disc holders typically cannot be conveniently stored. This is due to their generally bulky shape.

SUMMARY OF THE INVENTION

The present invention is designed to overcome the deficiencies of the prior art discussed above. It is an object of this invention to provide a compact disc holder which can be readily moved from a collapsed configuration to an upright, ready to use configuration.

It is a further object of the invention to provide such a holder which allows compact discs stored in the same to be readily viewed.

It is yet another object of the invention provide such a compact disc holder which has an aesthetically pleasing appearance.

It is still another object of the invention to provide a compact disc holder which is relatively inexpensive to manufacture.

In accordance with the illustrative embodiments, demonstrating features and advantages of the present invention, there is provided a collapsible compact disc holder which comprises a housing with a lower wall, an upper wall, a pair of opposing side walls, and a pair of opposing ends. Each of the upper and lower walls has two opposing side edges. Each of the side edges of the upper wall is hingedly connected to one of the side walls and each of the side edges of the lower wall is hingedly connected to a different one of the side walls. The housing is adapted to be moved between an upright rectangular configuration, wherein each of the side walls of the housing extends perpendicularly from corresponding side edges of the upper and lower walls, to a collapsed configuration, wherein the upper wall extends from one of the side walls along the same plane and the lower wall extends from the other of the side walls along the same plane. housing extends perpendicularly from corresponding side edges of the upper and lower walls, to a collapsed configuration, wherein the upper wall extends from one of the side walls along the same plane and the lower wall extends from the other of the side walls along the same plane.

First and second curved support members are provided. Each of the curved support members is insertable into one of the ends of the housing when the same is in the upright configuration. Each curved support member includes a column of vertically spaced apart slots for supporting a plurality of compact discs.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

FIG. 1 is a perspective view of a compact disc holder of the present invention in the collapsed condition;

FIG. 2 is a perspective view of the compact disc holder shown filled with compact discs;

FIG. 5 is a cross-sectional view taken along lines 5—5 of FIG. 3;

DETAILED DESCRIPTION OF THE PREFERRED EMBODIMENT

Figure 4:
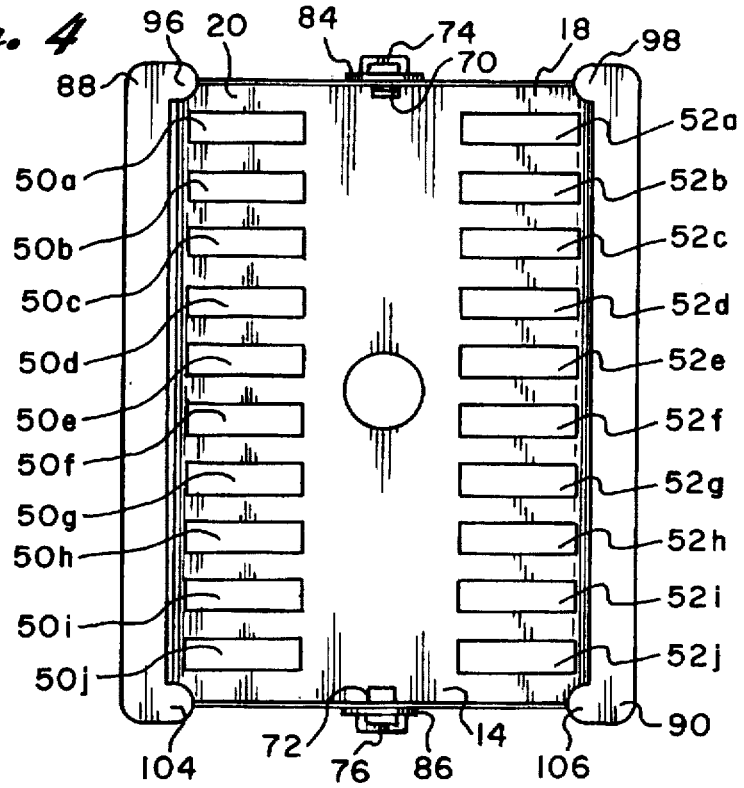
FIG. 4 is an end view of the compact disc holder.

Referring now to the drawings in detail wherein like reference numerals have been used throughout the various figures to designate like elements, there is shown in the figures a collapsible compact disc holder constructed in accordance with the principles of the present invention and designated generally as 10.

The compact disc holder 10 essentially comprises a rectangularly shaped housing or frame 12 with two curved support members 14 and 16 positioned therein (FIG. 1). Each of the curved support members includes two columns of vertically spaced slots 18, 20 therein. Every slot from one column is horizontally aligned with a slot from the other column in order to support a compact disc there in as more fully described below.

Figure 3:
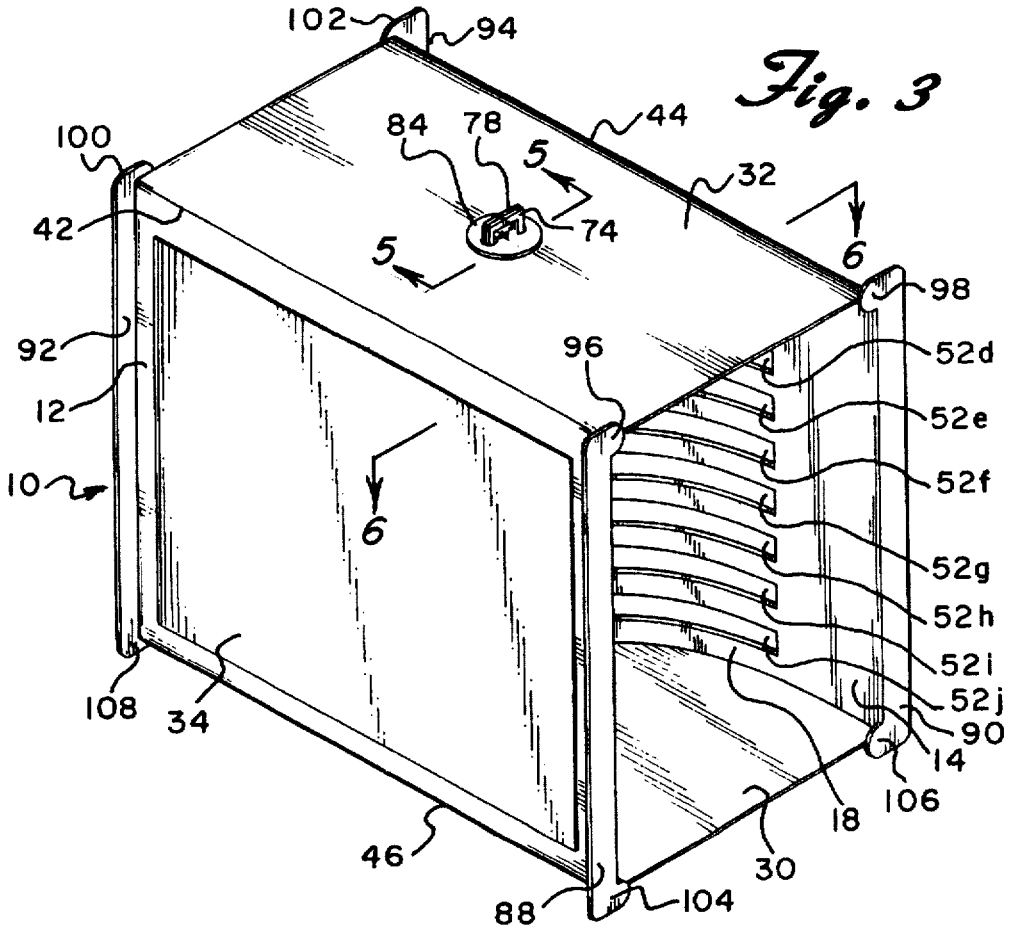
FIG. 3 is a perspective view of the compact disc holder of the present invention.
Figure 6:
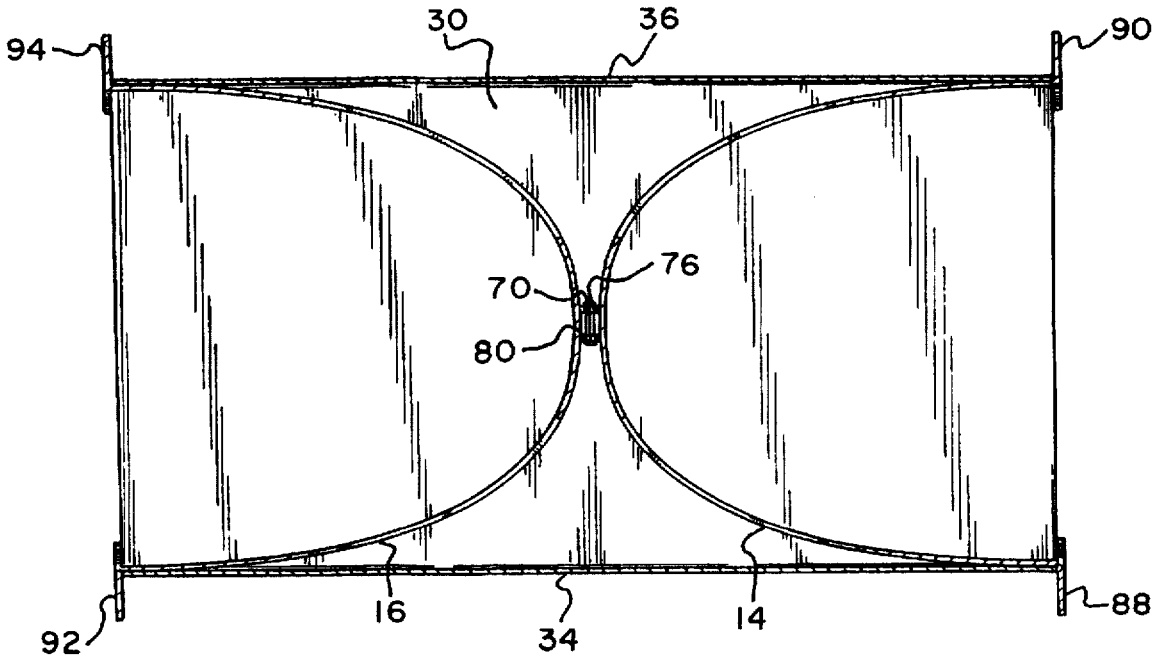
FIG. 6 is a cross-sectional view taken along lines 6—6 of FIG. 3.

The housing 12 includes a lower connecting member in the form of a lower wall 30, an upper connecting member in the form of an upper wall 32, a pair of opposing side walls 34 and 36, and a pair of open ends (FIGS. 1, 3 and 6). The side walls preferably have a design, logo or the like thereon in order to make the housing more aesthetically pleasing. The housing is preferably comprised of an elongated sheet of paperboard which has four fold lines 40, 42, 44, and 46 formed therein. The opposing ends of the elongated sheet are preferably adhesively secured to one another. Each of the fold lines functions as a living hinge between two adjacent walls of the housing. The fold lines allow the housing 12 to be moved between an upright rectangular configuration (FIG. 3), wherein the upper and lower walls 30 and 32, respectively, extend in perpendicular relation between the side walls of the housing, to a collapsed configuration (FIG. 1), wherein said upper wall extends from one of said side walls along the same plane and the lower wall extends from the other of said side walls along the same plane.

Figure 7:
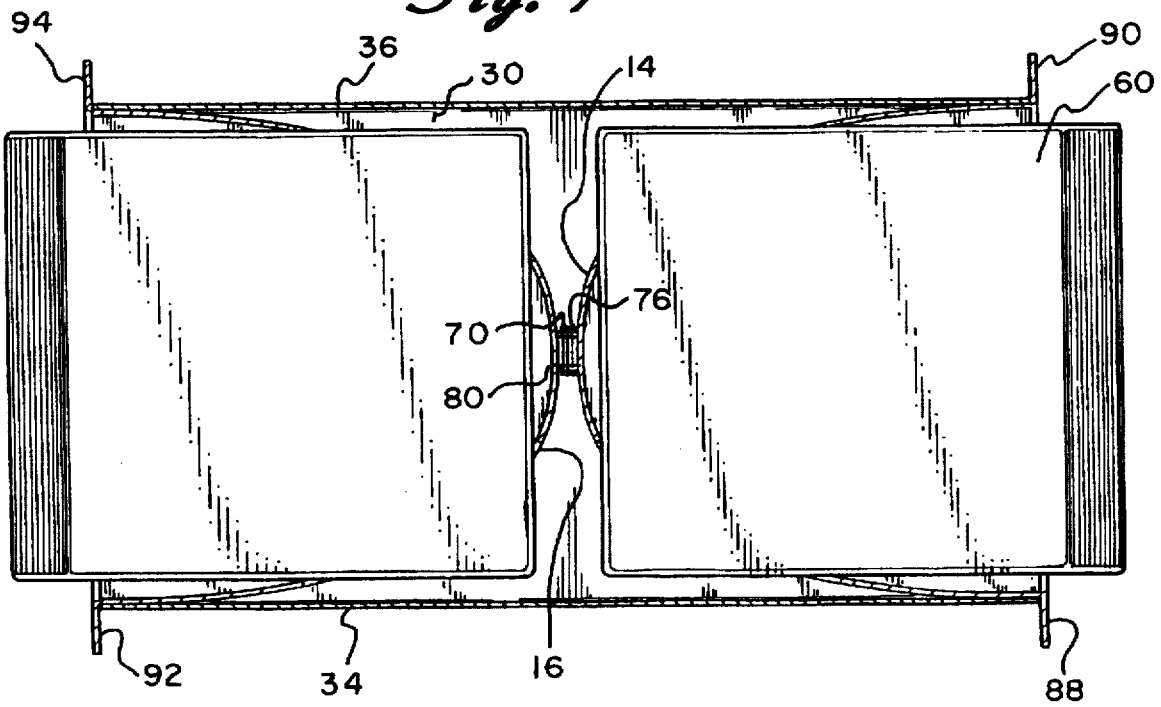
FIG. 7 is a cross-sectional view taken along lines 7—7 of FIG. 2.

When the housing 12 is ready to be used, it is first placed in the upright configuration. Thereafter, a first curved support member 14 is positioned in one of the open ends of the housing (FIGS. 3 and 4). A second curved support member 16 is positioned in the other one of the open ends of the housing (FIGS. 1, 6 and 7). The curved support members are preferably comprised of a substantially planar plastic sheet of material which is manually curved. The restoring force in the curved support members allows the same to once again obtain a planar configuration when removed from the housing as long as they are bent below the point of elastic deformation. Further, the restoring force causes the side edges of the curved support members to press against corresponding side walls of the housing. The two curved support members are substantially identical to one another. Accordingly, only one of the support members will be described in detail. It being understood that the description applies equally to the other curved support member.

The first curved support member 14 includes two columns 18 and 20 of vertically spaced apart slots. In the preferred embodiment, column 18 includes ten slots 50*a–j* as best shown in FIG. 4. Similarly, column 20 includes ten slots 52*a–j*. Every slot in column 18 is spaced from a corresponding slot in column 20 along the same horizontal plane. It should be noted that the number of slots in each column could be increased or decreased depending on the size of the compact disc holder 10.

The first curved support member 14 further includes an upper edge 62, a lower edge 64, and a pair of opposing side edges 66 and 68 (FIG. 1). When the first curved support member 14 is inserted into an open end of the housing, the upper edge of the first curved support member contacts the upper wall 32 of the housing 12 and the lower edge 64 of the first curved support member contacts the lower wall 30 of the housing in order to maintain the same in the upright configuration.

In the preferred embodiment, the housing 12 has a slotted opening 70 formed in the upper wall 32 and a slotted opening 72 formed in the bottom wall 30 of the same (FIG. 4). The upper and lower edges of the first curved support member 14 each have a tab 74 and 76, respectively, extending therefrom. Each tab is adapted to extend through a corresponding one of the slotted openings when the first curved member 14 is inserted into the open end of the housing 12 when the same is in the upright configuration FIG. 4). Second curved member 16 similarly has tabs 78 and 80 which each extend through a corresponding one of the slotted openings when the second curved member 16 is inserted into the other end of the housing 12. FIG. 5, for example, shows tab 78 extending through the slotted opening 70 in the housing 12.

An upper locking member 84 is preferably snap fitted over the two tabs 74 and 78 which extend through slotted opening 70 in the upper wall 32 of the housing 12. Similarly, a lower locking member 86 is snap fitted over the two tabs 76 and 80 which extend through slotted opening 72 in the lower wall 30 of the housing 12. The locking members releasably secure the curved support members in the housing 12.

In the preferred embodiment, there are two leg members 88 and 90, each of which is hingedly connected to a corresponding side edge 66 and 68, respectively, of the first curved support member 14. The second curved support member also includes two leg members 92 and 94 which are hingedly connected to opposite side edges of the same. The leg members extend at an angle from the curved support members in order to maintain the same in place within the housing as more fully described below. Each of the leg members has a laterally extending upper foot 96, 98, 100, and 102, and a laterally extending lower foot 104, 106, 108, and 110. The upper foot of each of the leg members extends beyond the upper wall 32 of the housing 12 an equivalent distance when the curved support members are secured within the housing. Similarly, the lower foot of each of the leg members extends beyond the lower wall 30 of the housing an equivalent distance.

It should be noted that the distance the tabs 74 and 78 extend through the slotted opening 70 in the upper wall 32 of the housing is preferably equal to the distance the upper feet of the leg members extend beyond the upper wall of the housing. Similarly, the distance the tabs 76 and 80 extend through the slotted opening 72 in the lower wall 30 of the housing 12 is preferably equivalent to the distance the lower feet of the leg members extend beyond the lower wall of the housing 12. Accordingly, when the compact disc holder is placed on top of a support surface there are five points which contact the support surface. By way of example, when the holder 10 is placed on the ground each of the lower feet 104, 106, 108, 110 contact the surface together with adjacently positioned tabs 76 and 80. Therefore, the compact disc holder is supported in each of its corners by the feet and in the center by the support tabs. Such support is necessary as the holder is preferably adapted to hold up to twenty compact discs.

In order to facilitate an understanding of the principles associated with the foregoing holder 10, its operation will now be briefly described. The housing 12 is placed in the upright configuration. Thereafter, the first curved support member 14 is inserted into an open end of the housing so that tabs 74 and 76 extend through slotted openings 70 and 72, respectively, and the leg members 88 and 90 extend outwardly at an angle from the end of the housing. The second curved support member 16 is then inserted into the other end of the housing so that tabs 78 and 80 also extend through slotted openings 70 and 72, and the leg members 92 and 94 extend outwardly at an angle from the housing. The upper and lower feet of each of the leg members press against the edge of a corresponding wall of the housing 12 in order to maintain the proper placement of the curved members in the housing.

Thereafter, locking member 84 is snap fitted over the tabs 74 and 78 which extend through slotted opening 70 in the upper wall 32 of the housing and locking member 86 is snap fitted over the tabs 76 and 80 which extend through slotted opening 72 in the lower wall 30 of the housing. The locking members ensure that the curved support members stay in place within the housing. However, it should be pointed out that even before the locking members are snap fitted over the tabs, the positioning of the tabs on each of the curved support members through the respective openings in the housing sufficiently maintains the curved support members in place. This facilitates the placement of the holder in its upright configuration by one person.

The compact disc holder is then ready to by filled with compact discs. In order to support each compact disc in one of the curved support members, a corner of the compact disc is inserted into a slot in one of the columns of one of the curved support members while an adjacent corner of the compact disc is inserted into a horizontally aligned slot in the other of the columns. By way of specific example, one corner of compact disc 60 is inserted into slot 50*a* in column 20 of the first curved support member 14 and an adjacent corner of the compact disc is inserted into slot 52*a* in column 18 of the first curved support member (FIG. 2). The compact disc is preferably inserted into the support member so that the side of the disc which has lettering thereon can be readily viewed. Each of the curved support members 18 and 20 is adapted to support ten compact discs therein in the manner described above.

The compact disc holder 10 can be readily placed in its collapsed configuration by first removing any compact discs supported therein. Thereafter, the locking members 84 and 86 are removed. The curved support members then are withdrawn from the housing by first removing the tabs from their respective slotted openings and then simply pulling each of the curved members out one of the ends of the housing. The fold lines in the housing allow the same to be collapsed to a substantially planar configuration. Further, the restoring force in each of the curved support members causes the same to revert back to its original planar configuration. It should be noted that each of the curved support members can be inserted into the housing when the same is placed in the collapsed configuration since each of the curved members is substantially planar in the unstressed condition. Such placement of the curved support members facilitates the packaging and shipping of the collapsible compact disc holder.

While the holder 10 has been described for storing compact discs therein, it should be readily apparent that the holder can be used to store a variety of differently sized disc shaped articles which are enclosed in generally rectangular casings. Accordingly, while specific reference may be made herein to compact discs, it will be understood that this is for convenience only and that it is intended to cover substantially any similarly packaged product. Further, the present invention may be embodied in other specific forms without departing from the spirit or essential attributes thereof and accordingly reference should be made to the appended claims rather than to the foregoing specification as indicating the scope of the invention.

What is claimed is:

1. A collapsible compact disc holder comprising:

a housing including a lower wall, an upper wall, a pair of opposing side walls, and a pair of opposing open ends, each of said upper and lower walls having two opposing side edges, each of said side edges of said upper wall being hingedly connected to a different one of said side walls, each of said side edges of said lower wall being hingedly connected to a different one of said side walls, said housing being adapted to be moved between an upright rectangular configuration, wherein each of said side walls of said housing extends perpendicularly from corresponding side edges of said upper and lower walls, to a collapsed configuration, wherein said upper wall extends from one of said walls along the same plane and the lower wall extends from the other of said side walls along the same plane, and a first curved support member removably inserted in one of said open ends of said housing when said housing is in the upright configuration, said first curved support member including a column of vertically spaced apart slots, each of said slots being adapted to partially receive a compact disc therein, said first curved support member further including an upper edge, a lower edge, and a pair of opposing side edges, said upper edge of said first curved support member contacting said upper wall of said housing and said lower edge of said first curved support member contacting said lower wall of said housing when said curved support member is positioned in said housing in order to maintain the same in the upright configuration.

2. The collapsible compact disc holder of claim 1 further including means for releasably securing said first curved support member between said upper and lower walls of said housing.

3. The collapsible compact disc holder of claim 2 wherein said releasably securing means includes:

each of said upper and lower walls of said housing having an opening therein;

each of said upper and lower edges of said first curved support member having a tab extending therefrom;

said tab on said upper edge of said first curved support member being adapted to extend through said opening in said upper wall of said housing and said tab on said lower edge of said first curved support member being adapted to extend through said opening in said lower wall of said housing.

4. The collapsible compact disc holder of claim 1 wherein force of said first curved support member has a restoring force which causes each of said support member to press against a corresponding one of said side walls of said housing when said first curved support member is positioned therein.

5. The collapsible compact disc holder of claim 1 wherein said first curved support member includes a second column of vertically spaced apart slots, each of said slots in said second column being spaced from and positioned along the same horizontal plane as a corresponding one of said slots in said first column of slots.

6. The collapsible compact disc holder of claim 1 further including a second curved support member being insertable in the other of said ends of said housing when said housing is in the upright configuration, said second curved support member including a column of vertically spaced apart slots therein, each of said slots of said second curved support member being adapted to support a compact disc.

7. The collapsible compact disc holder of claim 6 wherein each of said curved support members includes an upper edge, a lower edge, and a pair of opposing side edges, said upper edge of each of said curved support members contacting said upper wall of said housing and said lower edge of each of said curved support members contacting said lower wall of said housing when said curved support members are positioned in said housing in order to maintain the same in the upright configuration.

8. The collapsible compact disc holder of claim 7 further including means for releasably securing said curved support members between said upper and lower walls of said housing.

9. The collapsible compact disc holder of claim 8 wherein said releasably securing means includes:

each of said upper and lower walls of said housing having an opening therein;

each of said upper and lower edges of said first and second curved support members having a tab extending therefrom;

said tabs on said upper edges of each of said curved support members being adapted to extend through said opening in said upper wall of said housing and said tabs on said lower edges of said curved support members being adapted to extend through said opening in said lower wall of said housing.

10. The collapsible compact disc holder of claim 9 further including an upper locking member and a lower locking member, said upper locking member being adapted to releasably lock in place said tabs which extend through said opening in said upper wall of said housing, said lower locking member being adapted to releasably lock in place said tabs which extend through said opening in said lower wall of said housing.

11. The collapsible compact disc holder of claim 9 further including four leg members, each of said leg members extending from a corresponding one of said side edges of each of said curved support members, each of said leg members having an upper foot and lower foot, said upper feet of each of said leg members extending beyond said upper wall of said housing an equivalent distance, said lower feet of each of said leg members extending beyond said lower wall of said housing an equivalent distance.

12. The collapsible compact disc holder of claim 11 wherein said tab on said upper edge of each of said curved support members is adapted to extend through said opening in said upper wall of said housing a distance which is equivalent to said distance said upper feet of said leg members extend beyond said upper wall of said housing and wherein said tab on said lower edge of each of said curved support members is adapted to extend through said opening in said lower wall of said housing a distance which is equivalent to said distance said lower feet of said leg members extend beyond said lower wall of said housing.

13. The collapsible compact disc holder of claim 12 wherein each of said leg members is hingedly secured to a corresponding one of said side edges of said curved support members.

14. The collapsible compact disc holder of claim 7 wherein said first curved support member has a restoring force which causes each of said side edges of said support member to press against a corresponding one of said side walls of said housing when said first curved support member is positioned therein.

15. The collapsible compact disc holder of claim 6 wherein each of said curved support members includes a second column of vertically spaced apart slots, each of said slots in said second column being spaced from and positioned along the same horizontal plane as a corresponding one of said slots in said first column of slots.

16. A collapsible compact disc holder comprising:

a frame including a pair of spaced apart open ends, an upper connecting member and a lower connecting member, each of said ends having a substantially rectangular configuration, said frame being adapted to be moved between an upright rectangular configuration wherein said connecting members of said frame are parallel to each other but spaced apart and a collapsed configuration wherein said connecting members lie substantially in the same plane, and a first curved support member removably inserted in one of said ends of said frame when said housing is in the upright configuration, said first curved support member including a column of vertically spaced apart slots, each of said slots being adapted to partially receive a compact disc therein, said first curved support member further including an upper edge, a lower edge, and a pair of opposing side edges, said upper edge of said first curved support member contacting said upper connecting member of said frame and said lower edge of said first curved support member contacting said lower connecting member of said frame when said curved support member is positioned in said frame in order to maintain the same in the upright configuration.

17. The collapsible compact disc holder of claim 16 further including means for releasably securing said first curved support member between said upper and lower connecting member of said frame.

18. The collapsible compact disc holder of claim 17 wherein said releasably securing means includes:

each of said upper and lower connecting members of said frame having an opening therein;

each of said upper and lower edges of said first curved member having a tab extending therefrom;

said tab on said upper edge of said first curved support member being adapted to extend through said opening in said upper connecting member of said frame and said tab on said lower edge of said first curved support member being adapted to extend through said opening in said lower connecting member of said frame.

* * * * *

UNITED STATES PATENT AND TRADEMARK OFFICE

CERTIFICATE OF CORRECTION

PATENT NO. : 5,791,748

DATED : AUGUST 11, 1998

INVENTOR(S) : MATTHEW D. MARHEFKA

It is certified that error appears in the above-identified patent and that said Letters Patent is hereby corrected as shown below:

Column 6, line 7, after "said" insert --side edges of said--.

Signed and Sealed this

Seventh Day of September, 1999

*Attest:*

Q. TODD DICKINSON

*Attesting Officer*

*Acting Commissioner of Patents and Trademarks*